US006446795B1

(12) United States Patent
Allen et al.

(10) Patent No.: US 6,446,795 B1
(45) Date of Patent: Sep. 10, 2002

(54) TOWELETTE PACKAGING

(75) Inventors: Jan Allen, Arlington, VA (US); Kirsten Agee, Milton, MA (US); Tsi-Neng Ying, Silver Spring, MD (US)

(73) Assignee: The Gillette Company, Boston, MA (US)

( * ) Notice: Subject to any disclaimer, the term of this patent is extended or adjusted under 35 U.S.C. 154(b) by 52 days.

(21) Appl. No.: 09/629,754

(22) Filed: Jul. 31, 2000

(51) Int. Cl.[7] ..... B65D 81/24

(52) U.S. Cl. ..... 206/210; 206/438; 206/812; 15/104.93

(58) Field of Search ..... 206/210, 460, 206/438, 494, 205, 812, 229, 209, 440, 223, 484; 604/3, 289, 290, 306; 15/104.93, 104.94; 428/343

(56) References Cited

U.S. PATENT DOCUMENTS

| | | | | | |
|---|---|---|---|---|---|
| 3,344,915 | A | | 10/1967 | Rawlings | 206/56 |
| 4,427,111 | A | | 1/1984 | Laipply | 206/210 |
| 4,696,393 | A | * | 9/1987 | Laipply | 206/210 |
| 4,881,278 | A | * | 11/1989 | Farah | 206/209 |
| 4,896,768 | A | * | 1/1990 | Anderson | 206/210 |
| 4,917,675 | A | * | 4/1990 | Taylor et al. | 604/385.1 |
| 4,963,045 | A | * | 10/1990 | Willcox | 401/132 |
| 5,230,119 | A | | 7/1993 | Woods et al. | |
| 5,368,581 | A | * | 11/1994 | Smith et al. | 604/290 |
| 5,409,115 | A | * | 4/1995 | Barkhorn | 206/440 |
| 5,413,568 | A | * | 5/1995 | Roach et al. | 604/358 |
| 5,445,454 | A | * | 8/1995 | Barkhorn | 383/207 |
| 5,487,932 | A | * | 1/1996 | Dunshee | 15/104.93 |
| 5,507,906 | A | | 4/1996 | Woods et al. | |
| 5,520,629 | A | * | 5/1996 | Heinecke et al. | 602/57 |
| 5,569,230 | A | * | 10/1996 | Fisher et al. | 604/385.1 |
| 5,771,524 | A | | 6/1998 | Woods et al. | |
| 5,972,360 | A | | 10/1999 | Braun | |
| 6,007,264 | A | * | 12/1999 | Koptis | 15/104.93 |
| 6,170,653 | B1 | * | 1/2001 | Panzner | 206/210 |

FOREIGN PATENT DOCUMENTS

| | | |
|---|---|---|
| WO | WO 98/18446 | 5/1998 |
| WO | WO 98/29017 | 7/1998 |
| WO | WO 99/66793 | 12/1999 |
| WO | WO 00/00056 | 1/2000 |
| WO | WO 01/07001 A1 | 2/2001 |

OTHER PUBLICATIONS

Search Report.

* cited by examiner

*Primary Examiner*—Shian Luong
(74) *Attorney, Agent, or Firm*—Fish & Richardson P.C.

(57) ABSTRACT

A packaged towelette is provided including a flexible sheet material sealed around a pre-moistened towelette, the flexible sheet material including a fin constructed to allow a user to grasp the fin and open the package without touching the towelette.

13 Claims, 6 Drawing Sheets

TOWELETTE PACKAGING

This invention relates to packaging for towelettes.

BACKGROUND

Pre-moistened towelettes are used in many applications, for example in personal care. Personal care applications include towelettes that are used to cleanse the skin, e.g., to wipe one's hands or to wipe a baby's skin after a diaper change, and towelettes that include an antiperspirant or deodorant. Other applications include medical applications, e.g., alcohol wipes, and cosmetics, e.g., sunless tanning products and make-up.

These towelettes are generally packaged either in a single-use package, typically a sealed package formed of foil-backed paper that is torn open by a user, or a dispenser containing a large number of towelettes that are pulled sequentially from the dispenser through an opening. In either case, the towelette contacts the user's skin while the user is removing the towelette from its packaging.

SUMMARY

The invention features packaging for towelettes that reduces or even eliminates the need for the user to contact the product with the user's hands during opening of the packaging, use and disposal of the product. The "touch-free" nature of preferred packaging of the invention is attractive to users in situations in which it may be unpleasant or otherwise undesirable to touch the liquid with which the towelette is moistened with one's fingers, e.g., if the liquid is an antiperspirant or a cosmetic that would stain the skin.

In one aspect, the invention features a packaged towelette including a flexible sheet material sealed around a pre-moistened towelette, the flexible sheet material including a fin constructed to allow a user to grasp the fin and open the package without touching the towelette.

Implementations of the invention may include one or more of the following features. The pre-moistened towelette is adhered to an inner surface of the flexible sheet material, e.g., by heat-sealing. The package includes a beveled edge to facilitate peeling open of the sealed flexible sheet material. The package is half-octagonal in shape. Alternatively, the package is substantially oval in shape. The fin is constructed to serve as a handle, to allow the user to grip the packaged towelette during use of the pre-moistened towelette, and positioned so that, during use, the flexible sheet material will act as a barrier, preventing contact between the user's fingers and the pre-moistened towelette. The pre-moistened towelette is moistened with a fluid selected from the group consisting of antiseptics, cleansers, cosmetics and toiletries. Preferably, the fluid includes an antiperspirant, a deodorant, or an antiperspirant/deodorant. The fin has a height of at least 5 mm, more preferably about 8 to 15 mm. The fin is folded flat against a surface of the flexible sheet material prior to use of the towelette. The pre-moistened towelette is moistened with a liquid, gel, cream, emulsion or soft solid. Preferably, the liquid, gel, cream, emulsion or soft solid includes an antiperspirant, deodorant, or antiperspirant/deodorant.

In another aspect, the invention features methods of using the packages of the invention. For example, the invention features a method of applying a product to the skin, the product being provided in a package comprising a flexible sheet material the edges of which are sealed around a pre-moistened towelette containing the product, the flexible sheet material including a fin. The method includes (a) grasping the fin, (b) pulling the sealed edges of the flexible material apart to expose the pre-moistened towelette, and (c) contacting the skin with the pre-moistened towelette while continuing to grasp the fin.

The packaged towelettes described herein may be used in many applications, e.g., as antiperspirant or deodorant wipes, antiseptic wipes (e.g., alcohol or iodine wipes), and to apply cosmetics and toiletries such as sunscreen, aftershave, insect repellant, make-up and the like.

Other features and advantages of the invention will be apparent from the description and drawings.

DETAILED DESCRIPTION

Figure 1:
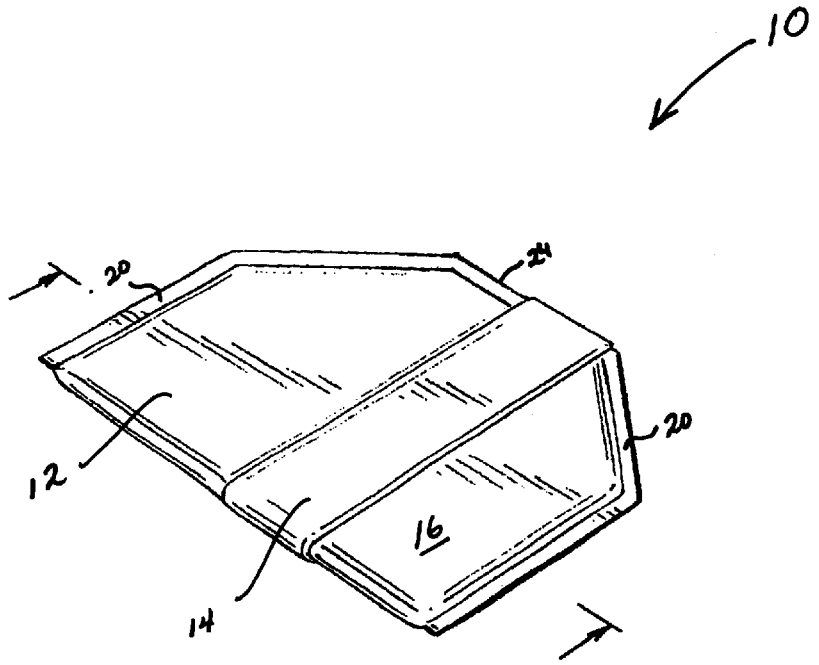
FIG. 1 is a perspective view of a packaged towelette according to one embodiment of the invention.
Figure 1A:
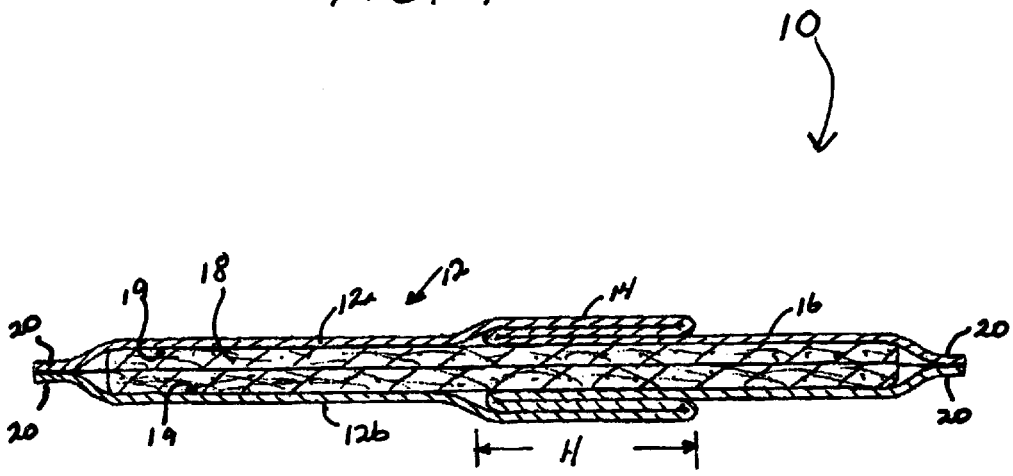
FIG. 1A is a cross-sectional view of the packaged towelette, taken along line A—A in FIG. 1.

Referring to FIGS. 1 and 1A, a packaged towelette 10 includes a wrapper 12, having a fin 14 that is folded against the surface 16 of the wrapper, as shown, during storage of the packaged towelette 10. Within the wrapper 12 is a pre-moistened towelette 18 (FIG. 1A). The towelette 18 is sealed to the inner surface 19 of wrapper 12, for reasons that will become apparent in the following description of FIGS. 2–2E. As shown in FIG. 1A, the edges 20 of the top and bottom portions 12*a*, 12*b* of wrapper 12 are sealed together in a fluid-tight and substantially air-tight manner, to prevent drying out of the towelette 18 and leakage of the fluid with which the towelette 18 is moistened. The seal must also be "peelable", i.e., readily separated by a user when the user wishes to open the package, as will be discussed in further detail below. The fin preferably has a height H (FIG. 1A) of at least 5 mm, more preferably from about 8 to 15 mm, to enable it to be easily grasped by a user.

The wrapper 12 is a single sheet of flexible material that is folded approximately in half to enclose the towelette 18. The fin 14 extends substantially perpendicular to the fold line, so that the fin can be grasped by the user and used to break the seal at edges 20 and thereby expose the towelette 18.

Figure 2:
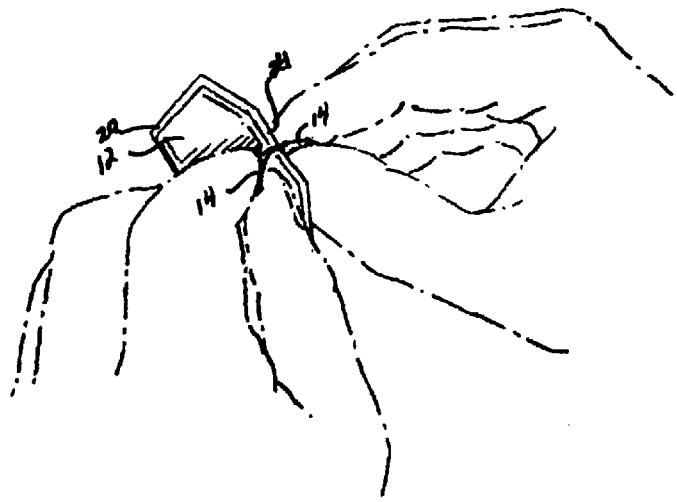
FIGS. 2–2E are schematic perspective views showing a user opening the packaged towelette shown in FIG. 1 and using the towelette within the packaging (the user's hands are shown in phantom lines).
Figure 2A:
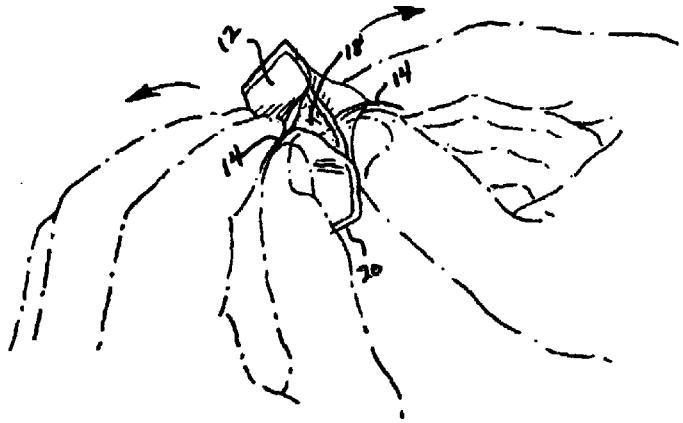
Figure 2B:
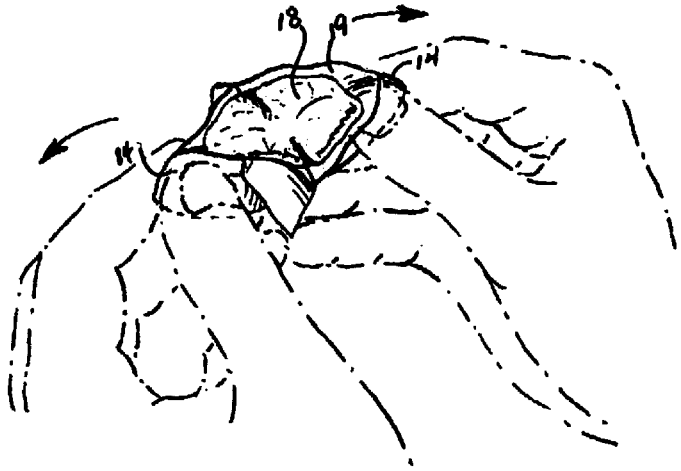
Figure 2C:
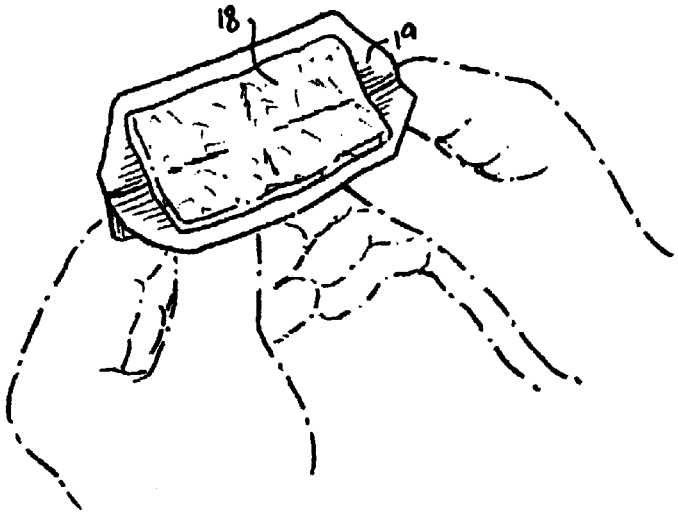
Figure 2D:
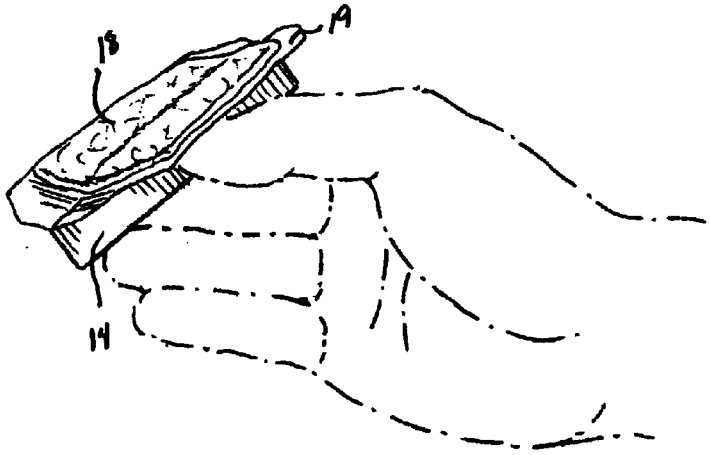
Figure 2E:
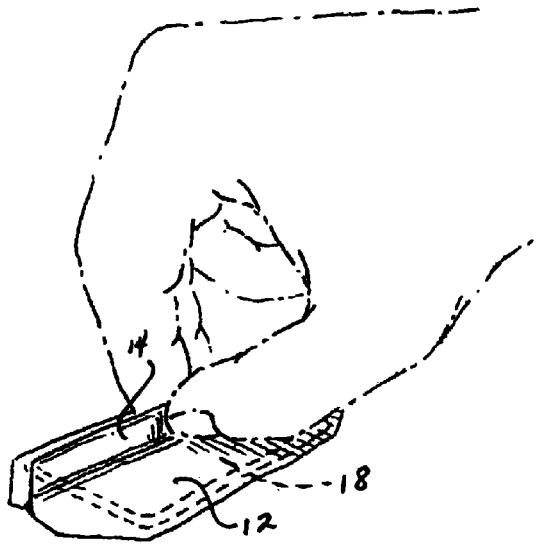

FIGS. 2–2E illustrate a user opening the packaged towelette 10 and using the towelette 18. As shown in FIG. 2, the user first grasps the fin 14 and raises it from its folded over position (FIGS. 1–1 A) to a position in which it can be grasped by the user's fingers. Next, grasping the fin with both hands, the user peels the seal 20 open by separating his hands (arrows, FIGS. 2A, 2B). The package preferably has a half-octagonal, beveled shape, as shown, rather than a rectangular shape, to enable the seal to be more easily peeled open. The beveled edge allows an optimal distribution of the force applied by the user during the step shown in FIGS. 2A and 2B, and it is easier for the user to break the short top seal along edge 24 (FIG. 2) than it would be to break the relatively long top seal of a rectangle. The user continues to peel apart the seal 20 until the wrapper is completely open and the towelette 18 is substantially flat (FIG. 2C). Then, the user can hold fin 14 with one hand, and apply the fluid on the towelette 18 to a desired area without ever having to touch towelette 18 with his fingers (FIGS. 2D, 2E). Because the towelette 18 is adhered to the inner surface 19 of the outer wrapper, the user can use the fin 19 of the wrapper as a handle, and the wrapper 12 as a protective covering that keeps the fluid on the towelette 19 from contacting the user's hands.

Figure 3A:
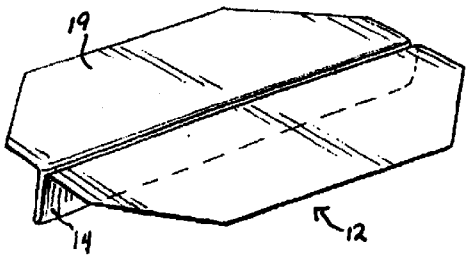
FIGS. 3–3C are schematic views showing steps in a process for forming the packaged towelette shown in FIG. 1.
Figure 3:
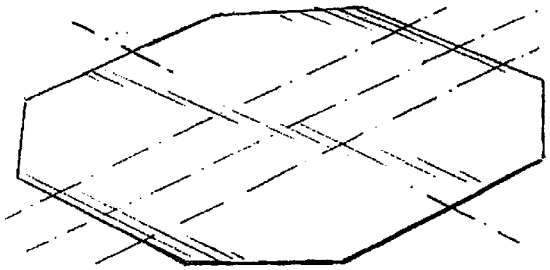
Figure 3C:
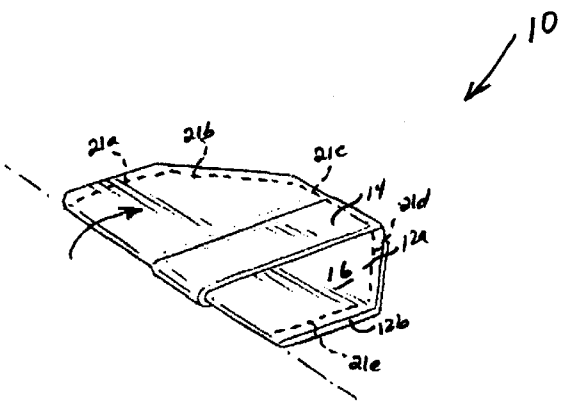

A process for manufacturing the packaged towelette 10 is shown in FIGS. 3–3C.

Figure 3B:
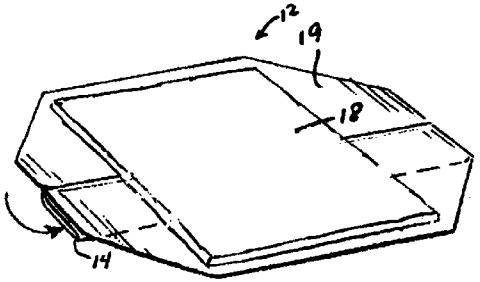

The starting blank is shown in FIG. 3, with fold lines indicated by dashed lines. The blank is folded along the fold lines, and sealed, e.g., heat-sealed, to form fin 14, as shown in FIG. 3A. Next, the fin 14 is folded over against surface 16 (FIG. 1A) of the wrapper 12, and the towelette 18 is adhered to surface 19, e.g., by heat-sealing or adhesive, as shown in FIG. 3B. The wrapper and towelette are then folded in half, as shown in FIG. 3C. The overlapping edges of the top and bottom portions 12*a*, 12*b* of wrapper 12 are heat sealed (dotted lines 21*a*–21*e*, FIG. 3C), to form the final product shown in FIGS. 1 and 1A. The side seals 21*a*, 21*b*, 21*d* and 21*e* are formed first, after which the liquid with which the towelette is to be moistened is added to the thus-formed package. Finally, sealing of the package is completed (top seal 21*c* is applied), resulting in the product shown in FIGS. 1 and 1A.

Figure 4:
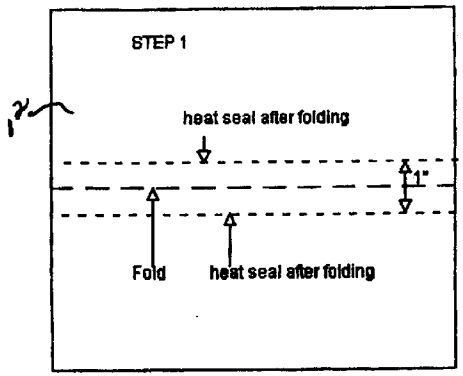
FIGS. 4–4D are schematic views showing steps in an alternative process for forming the packaged towelette shown in FIG. 1.
Figure 4A:
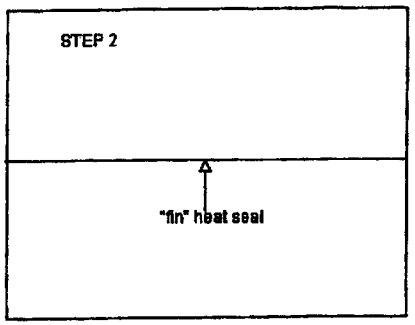
Figure 4B:
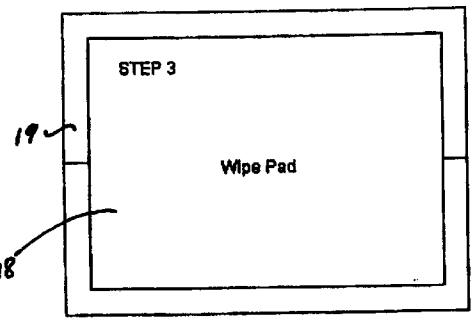
Figure 4C:
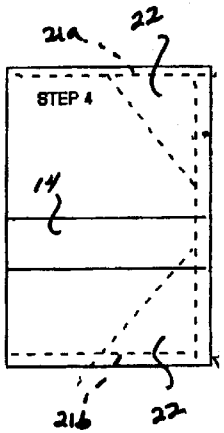
Figure 4D:
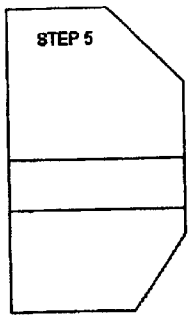

It is noted that in these figures the sealing and folding steps described above are conducted on a blank that has been pre-cut to an octagonal shape, to create the half-octagon package shown in FIGS. 1 and 1A. However, the same shape can be achieved using a rectangular blank, as shown in FIGS. 4–4D, by sealing the top and bottom portions 12*a*, 12*b* of wrapper 12 in a half-octagon shape (FIG. 4C), and removing the comers 22 after sealing. This process may provide manufacturing advantages, in that the long side seals 21*a*, 21*b* that are applied prior to moistening of the towelette will create a rectangular package that may be easier to fill with fluid than the half octagonal package with only short top seal 21*c* left open.

Any other suitable method can be used to form packaged towelette 10, as will be apparent to those skilled in the art.

Suitable wrapper materials are those which are relatively vapor impermeable, to prevent drying out of the towelette, and able to form a "peelable" seal. Preferred wrapper materials include polypropylene and laminates of polypropylene with other layers. In the case of laminates, the polypropylene layer is preferably exposed for sealing to itself along edges 20 as described above. A preferred laminate is a polypropylene/aluminum foil/polystyrene laminate commercially available from Marsh Biomedical Products, 565 Blossom Road, Rochester, N.Y. 14610 under the tradename "Easy Peel Heat-Sealing Foil Roll". In this case, the foil layer, positioned between the polypropylene and polystyrene layers, provides a vapor barrier, and the polystyrene layer, positioned on the exterior of the finished package, provides flexibility.

Suitable materials for the towelette will depend upon the fluid to be applied and the surface to which it will be applied, but will generally include nonwovens, felts, cotton fabric, cellulose, foams, and other materials conventionally used in wipes. Preferably, the towelette material is heat-sealable to the inner surface of the wrapper, but alternatively the towelette may be adhered to the wrapper using an adhesive. Examples of suitable towelette materials include a polypropylene nonwoven (for heat-sealing) and a felt having a pressure-sensitive adhesive, protected by a release sheet, on one side, e.g., a felt commercially available from Kunin Felt, 380 Lafayette Road, Hampton, N.H. 03843 under the tradename Presto™ Felt (for adhesive application). A suitable polypropylene non-woven is spunbound polypropylene, PGI Nonwovens, 201 N. Church Street, Mooresville, N.C. 28115. Other suitable materials include polyester resins, polyethylene terephthalate (PET), and polyester polypropylene blends. Additionally, foams may be preferred for some embodiments.

Figure 5A:
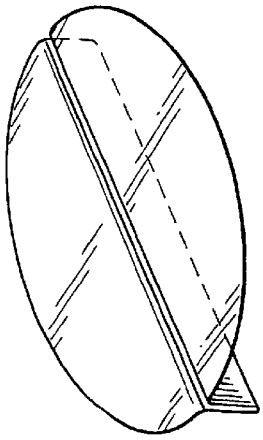
FIGS. 5–5C show a packaged towelette according to an alternate embodiment of the invention.
Figure 5C:
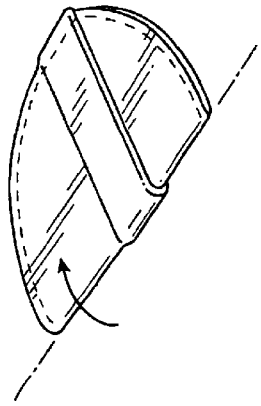
Figure 5:
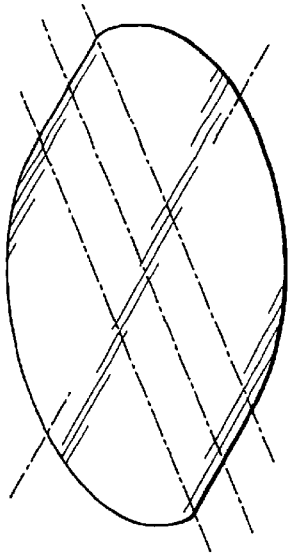
Figure 5B:
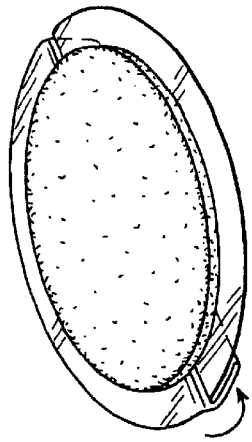

Other embodiments are within the claims. For example, while the wrapper has been shown as having an octagonal shape when unfolded, it may have any desired shape, e.g., square, rectangular, oval (as shown in FIGS. 5–5C), or round, and may have any desired dimensions.

What is claimed is:

1. A packaged towelette comprising a flexible sheet material sealed around an internal pre-moistened towelette, the flexible sheet material including an external fin constructed to allow a user to open and use the package without touching the towelette, wherein the sheet material comprises a single sheet folded upon itself, along a fold line, to enclose the towelette, and the fin extends substantially perpendicular to the fold line, whereby the fin may be grasped by a user to facilitate opening the sealed flexible sheet material to expose the towelette and then used as a handle to rub the towelette against the skin, thereby preventing contact between the user's fingers and the towelette.

2. The packaged towelette of claim 1 wherein said pre-moistened towelette is adhered to an inner surface of said flexible sheet material.

3. The packaged towelette of claim 2 wherein said towelette is heat-sealed to said inner surface.

4. The packaged towelette of claim 1 wherein the package includes a beveled edge to facilitate peeling open of the sealed flexible sheet material.

5. The packaged towelette of claim 4 wherein said package is half-octagonal in shape.

6. The packaged towelette of claim 4 wherein said package is substantially oval in shape.

7. The packaged towelette of claim 1 wherein said pre-moistened towelette is moistened with a fluid selected from the group of antiseptics, cleansers, cosmetics and toiletries.

8. The packaged towelette of claim 1 wherein said fluid comprises an antiperspirant, a deodorant, or an antiperspirant/deodorant.

9. The packaged towelette of claim 1 wherein said fin has a height of at least 5 mm.

10. The packaged towelette of claim 9 wherein said fin has a height of from about 8 to 15 mm.

11. The packaged towelette of claim 1 wherein said fin is folded flat against a surface of said flexible sheet material prior to use of the towelette.

12. The packaged towelette of claim 1 wherein said pre-moistened towelette is moistened with a liquid, gel, cream, emulsion or soft solid.

13. The packaged towelette of claim 12 wherein said liquid, gel, cream, emulsion or soft solid comprises an antiperspirant, deodorant, or antiperspirant/deodorant.

* * * * *